US005792039A

United States Patent [19]

Green et al.

[11] Patent Number: 5,792,039

[45] Date of Patent: Aug. 11, 1998

[54] DECANTER CENTRIFUGE FOR SEPARATING FEED SUSPENSION INTO FRACTIONS AND METHOD FOR OPERATING SAME

[75] Inventors: Roger Richard Green, St. Austell; Thomas George Hoskin, Bodmin, both of United Kingdom

[73] Assignee: ECC International Ltd., United Kingdom

[21] Appl. No.: 862,452

[22] Filed: May 23, 1997

[30] Foreign Application Priority Data

May 29, 1996 [GB] United Kingdom ..... 9611209

[51] Int. Cl.[6] ..... B04B 1/20

[52] U.S. Cl. ..... 494/54; 494/53

[58] Field of Search ..... 494/50–54; 210/380.1, 210/380.3

[56] References Cited

U.S. PATENT DOCUMENTS

| | | | |
|---|---|---|---|
| 3,096,282 | 7/1963 | Trotter, Jr. | 494/53 X |
| 3,419,211 | 12/1968 | Yasuda et al. | 494/53 |
| 3,782,623 | 1/1974 | Bye-Jorgensen et al. . | |
| 4,743,226 | 5/1988 | Day et al. | 494/53 |
| 4,915,681 | 4/1990 | Suzuki | 494/54 |
| 5,151,079 | 9/1992 | Flanigan et al. | 494/53 X |
| 5,234,400 | 8/1993 | Kluge | 494/54 |
| 5,252,209 | 10/1993 | Retter | 494/53 X |
| 5,545,119 | 8/1996 | Schilp et al. | 494/53 X |
| 5,584,791 | 12/1996 | Grimwood et al. | 494/54 |

FOREIGN PATENT DOCUMENTS

| | | |
|---|---|---|
| 0600628 | 6/1994 | European Pat. Off. . |
| 670306A | 11/1929 | France . |
| 2515452A | 10/1976 | Germany . |
| 3620912A1 | 12/1987 | Germany . |
| 372679 | 5/1932 | United Kingdom . |
| 2088255 | 6/1982 | United Kingdom . |
| 2099334 | 12/1982 | United Kingdom . |
| 2255591 | 11/1992 | United Kingdom . |
| WO 87/06856 | 11/1987 | WIPO . |

*Primary Examiner*—Charles E. Cooley
*Attorney, Agent, or Firm*—Suzanne Kikel

[57] ABSTRACT

A decanter centrifuge for separating a feed suspension of a particular solid material in a liquid into two fractions, i.e. a heavy fraction containing heavy particles and a light fraction containing light particles, or no particles at all, is described. The centrifuge has a rotatably mounted elongated bowl having closed ends with a side wall extending therebetween. A helical scroll is rotatably mounted coaxially within the bowl, and the bowl and the scroll may be rotated at different rotational speeds. A pipe coaxially mounted in a tubular shaft and rotatably supporting the scroll, feeds the suspension into the bowl. Several outlets in the wall of the bowl discharge the heavy fraction from the bowl. The light fraction travels through the length of the bowl by the helical scroll and is discharged from outlets located downstream from those that discharge the heavy fraction. The delivery region is also nearer to the outlets for the heavy fraction than to the outlets for the light fraction. The centrifuge can be used for concentrating an aqueous suspension of an inorganic particulate mineral material, such as kaolin, metakaolin, calcium carbonate, or calcium sulphate or for separating such a material into heavy and light fractions, eg. to produce a finer fraction product.

13 Claims, 1 Drawing Sheet

DECANTER CENTRIFUGE FOR SEPARATING FEED SUSPENSION INTO FRACTIONS AND METHOD FOR OPERATING SAME

BACKGROUND OF THE INVENTION

1. Field of the Invention

The present invention relates to a decanter centrifuge.

The invention concerns apparatus for centrifugally separating a suspension of a particulate solid material in a liquid medium into an overflow stream comprising a suspension of relatively light particles in the liquid medium and an underflow comprising a generally more concentrated suspension of relatively heavy particles in the liquid medium. If the particulate material comprises particles which have substantially the same density but different sizes the relatively heavy particles will be those having larger sizes. Alternatively, the apparatus may be used for separating the denser particles from a mixture comprising particles of similar size but different densities. The invention also concerns a process in which apparatus of the type described above is used to classify a particulate mineral material in suspension in a liquid into a fine particle size fraction and a coarse particle size fraction. The invention also concerns a process wherein a suspension of a particulate material is concentrated, eg. wherein an aqueous suspension is concentrated by dewatering, by use of such an apparatus.

2. Description of the Prior Art

Many types of decanter centrifuge are used in commerce for separating particles suspended in a liquid medium into a relatively heavy fraction and a relatively light fraction or for concentrating such suspensions. These centrifuges generally have the common feature that they comprise a centrifuge bowl which is cylindrical or frusto-conical in shape, or has both a cylindrical and a frusto-conical section, the longitudinal axis of the bowl being generally horizontal. The bowl is rotated by means of an electric motor about its longitudinal axis at a speed such as to generate a centrifugal acceleration many times that of gravity. A suspension in a liquid containing particles to be classified according to size or weight is introduced into the interior of the rotating bowl and forms a pond of annular cross section around the peripheral region of the bowl. The heavier particles are preferentially flung to the walls of the bowl, the lighter particles tending to remain in suspension. A scroll mechanism in the form of a helical screw is mounted inside the bowl and is rotatable about the same longitudinal axis as the bowl. The scroll mechanism is driven by the same electric motor as the bowl, through a gearbox which causes the scroll mechanism to rotate at a different speed from that of the bowl, and in a direction such as to convey the suspension of heavier particles which is deposited on the wall of the bowl towards one end of the bowl where suitable discharge ports for this fraction are provided. Alternatively, the scroll mechanism may be driven by its own independent motor. In the case in which the bowl has a frusto-conical section, the heavy fraction is generally discharged at the end of the bowl which has the smaller diameter as this arrangement makes it possible for the heavy fraction to be drawn up an inwardly tapering region of the bowl wall through the inner surface of the pond on to a relatively dry "beach", so that some draining of this fraction can take place, and a relatively dry heavy fraction can be obtained.

U.S. Pat. No. 5234400 (Kluge) describes a decanter centrifuge which has an elongated bowl rotating about a horizontal axis. The overall length of the bowl is generally about four times the greatest diameter of the bowl, and the bowl has a relatively long cylindrical section and a relatively short frusto-conical section, the length of the cylindrical section being about four times that of the frusto-conical section. A feed suspension of particulate solid material in a liquid is introduced close to the cylindrical end of the bowl and forms a pond of annular cross section which flows along the bowl towards the frusto-conical end. Relatively heavy particles sediment preferentially against the wall of the bowl and are conveyed towards the frusto-conical end by means of a helical scroll which rotates at a speed slightly different from that of the bowl. A plurality of discharge nozzles for the heavy fraction is provided a short distance from the frusto-conical end of the bowl disposed around a transverse section of the bowl of diameter close to, or equal to, the greatest diameter of the bowl, and the light fraction is discharged through openings at the extreme end of the frusto-conical part of the bowl, the openings being disposed around a transverse section of the bowl of diameter close to the smallest diameter of the frusto-conical part of the bowl.

German offenlegungsschrift 3620912 (Klockner-Humboldt-Deutz) describes a solid bowl scroll centrifuge for separating particles in suspension in a liquid wherein the suspension in the bowl is moved in one direction by a scroll in co-current flow. With the suspension being introduced at a first end of the bowl and moving from the first end to a second end of the bowl, the light fraction is discharged at the first end, and the heavy fraction is discharged at the second end through nozzles.

U.S. Pat. No. 3782623 (Bye-Jorgensen et al.) describes a solid bowl scroll centrifuge for separating particles in suspension in a liquid wherein the feed suspension is introduced into a first end of the bowl and both the heavy fraction and the light fraction are discharged at, or near, a second end of the bowl.

SUMMARY OF THE INVENTION

According to the present invention in a first aspect there is provided a decanter centrifuge for separating a feed suspension of particulate solid material in a liquid medium into a light fraction comprising a suspension of relatively light particles in the liquid medium or liquid medium containing substantially no particles and a heavy fraction comprising a suspension of relatively heavy particles in the liquid medium, which centrifuge comprises an elongated bowl having a first closed end, a second closed end and a side wall between the ends, the bowl being mounted for rotation about its axis, a helical scroll mounted for rotation within, and coaxially with the bowl, driving means for rotating the bowl and scroll about their common axis whereby the scroll and the bowl can be rotated with different rotational speeds, means for delivering feed suspension into the bowl in a delivery region inside the bowl a plurality of first outlets provided in the wall of the bowl for discharging the heavy fraction from the bowl and one or more second outlets provided at or near to the first end of the bowl for discharging the light fraction from the bowl and wherein the delivery region is nearer to the second end of the bowl than to the first end of the bowl and the first outlets are located close to the delivery region.

By 'relatively heavy' particles is meant particles which are heavy compared with any particles contained in the light fraction.

The said delivery region may comprise one or more regions inside the bowl wherein the feed suspension is injected to be treated by the centrifuge. The delivery region may be one or more regions between adjacent turns of the scroll. When the centrifuge is in operation the feed suspension in the delivery region may be in a turbulent state.

Preferably, the distance, measured longitudinally along the bowl between the centre of the delivery region and the first outlets is less than 0.3l, more preferably less than 0.1l, desirably between 0.01l and 0.05l, where l is the length of the internal cavity of the bowl.

Preferably, the delivery region is nearer than the first outlets to the second end of the bowl.

The scroll may conveniently be provided on, eg. fixed or bonded to or formed integrally with, an axially extending tubular member having inlet openings through which the feed suspension can be delivered. The said delivery region thereby comprises one or more regions extending into the cavity of the bowl from the inlet opening(s). Such region(s) may be regions which generally are level (in a transverse sense relative to the axis of the bowl) with the opening(s). The inlet openings may be a plurality of openings disposed on an arc extending circumferentially around the axis of the tubular member. Thus, the average distance measured longitudinally along the bowl between the centre of the said inlet openings and the said first outlets, is preferably less than 0.3l, more preferably less than 0.1l, desirably between 0.01l and 0.05l, where l is as defined above.

A means for delivering feed suspension may include a feed pipe extending along the inside of the said tubular member from the first end of the bowl and an enclosure formed inside the tubular member in a region which includes the said openings, the feed pipe having an open end in the enclosure whereby feed suspension delivered along the feed pipe debouches into the enclosure and can exit the enclosure via the inlet openings to enter the said delivery region.

The wall of the bowl may comprise a section of narrowing diameter near to the second end of the bowl. This section may be shorter in length than the remainder of the bowl and may comprise a frusto-conical section having its narrowest diameter adjacent to the second end. The major part of the wall of the bowl may have a right circular cylindrical form.

In a preferred form of the centrifuge according to the present invention, the wall of the bowl comprises a frusto-conical section adjacent to the second end of the bowl and a right circular cylindrical section extending from the frusto-conical section to the first end of the bowl. Preferably, the said first outlets in the wall of the bowl and desirably also the said delivery region (eg. inlet openings) are close to the junction between the frusto-conical section and the cylindrical section, conveniently in or inside (as appropriate) the cylindrical section.

The ratio of the overall length of the bowl to the greatest diameter of the bowl may be in the range of from 2:1 to 5:1, and is preferably from about 3:1 to about 4:1. The ratio of the longitudinal distance of the centre of the delivery region to the second end of the bowl to the longitudinal distance of the centre of the delivery region to the first end of the bowl may be in the range of from 5:1 to 10:1, and is preferably from about 6:1 to about 8:1. Where the centrifuge according to the present invention is in the said preferred form, the ratio of the length of the cylindrical section to the length of the frusto-conical section may be in the range of from 5:1 to 10:1, preferably from 6:1 to 8:1.

The helical scroll may in use be rotated at a speed relative to that of the bowl, and in a direction, such that the material of the heavy fraction which is sedimented against the wall of the bowl by centrifugal action is conveyed by the scroll in the direction from the first end of the bowl toward the second end (or toward the first openings) and the light fraction moves toward the first end of the bowl.

The said second outlet(s) may comprise opening(s) through a cover plate at the first end of the bowl.

Preferably, the outlets for the heavy fraction are nozzles for discharging the heavy fraction. Preferably, these are disposed around an arc in the cylindrical section of the bowl near to the junction between the cylindrical and frusto-conical sections in the said preferred form. Advantageously the screw form of the part of the scroll located between the outlets for the heavy fraction and the second end of the bowl is reversed with respect to the screw form of the major part of the scroll (between the outlets for the heavy fraction and the first end of the bowl) so that any heavy fraction which is deposited on the inner surface of the bowl wall between the discharge outlets for the heavy fraction and the second end of the frusto-conical section is conveyed back towards the outlets for the heavy fraction. The narrowing diameter, eg. frusto-conical, section, where present, facilitates this conveyance of the heavy fraction.

The arrangement by which the feed suspension is introduced near one end of the bowl (the second end) and the outlets for discharge of the heavy fraction are also disposed near the same end of the bowl, while the outlets for the fine fraction are at or near to the opposite end, the first end of the bowl, has the advantage that, as the suspension flows from the delivery region towards the first end of the bowl, the heaviest particles are sedimented first, and it is therefore necessary for the scroll to convey these particles only a small distance to the discharge outlets. This means that a lighter load is exerted on the scroll for a given feed rate than with certain prior art centrifuges in which the heaviest particles must be conveyed along a major proportion of the length of the bowl. This allows reduction of the time, energy and cost of the separation process using the centrifuge. In addition, abrasive wear of the periphery of the scroll and of the wall of the bowl is greatly reduced in comparison with that experienced in decanter centrifuges in which the heaviest, and therefore generally most abrasive particles, are conveyed a greater distance along the bowl wall as in the prior art.

The bowl in the centrifuge according to the present invention may be rotated by a drive means connected to the second end of the bowl. The second end may, for example, include a socket in which an attachment to a drive means, eg. drive pulley, is connected. Such a drive pulley may be driven, for example, by an electric motor. The scroll may be independently rotated in the same sense as but at a different speed from the rotation of the bowl by a further rotation drive means, eg. by a motor provided outside the bowl beyond the first end thereof. Such a motor may comprise an hydraulic motor.

The decanter centrifuge in accordance with the invention is particularly suitable for performing particle size separations or classifications, eg. to obtain a finer product fraction, of particulate mineral materials contained in an aqueous suspension. The centrifuge may also be employed to dewater or concentrate such suspensions. The particulate mineral material may comprise a known material to be used as a particulate pigment, filler or extender material, for example kaolin clay, metakaolin, calcium carbonate, calcium sulphate and the like. It may be necessary for the suspension first to be treated with a dispersing agent which will cause the particles to repel one another and thus be present in the suspension in the form of discrete particles rather than clusters of particles. Suitable dispersing agents for the suspension to be treated are in general well known in the art. Such dispersing agents include water soluble polyphosphate salts, such as tetra sodium pyrophosphate or sodium hexametaphosphate, water soluble salts of a polysilicic acid, such as sodium silicate, or a polyelectrolyte such as a water soluble salt of poly(acrylic acid), of poly(methacrylic acid) or of a similar homopolymer or copolymer of an ethylenically unsaturated organic acid or a salt of one of these acids.

The decanter centrifuge in accordance with the invention is also suitable for increasing the solids concentration of a relatively dilute aqueous suspension of a particulate mineral material. In this case it is neither necessary nor desirable to treat the suspension with a dispersing agent. In fact it is preferred that the solids in the suspension should be in a generally flocculated condition, that is in the form of clusters of particles rather than discrete particles. Under these conditions, substantially particle-free water will be discharged through the outlets provided for the light fraction, and a concentrated suspension of the particulate mineral material will be discharged through the outlets provided for the discharge of the heavy fraction.

According to the present invention in a second aspect there is provided a method of separating a suspension of a particulate solid material in a liquid medium into a heavy fraction and a light fraction which method comprises applying the suspension to the inlet of a centrifuge according to the first aspect of the present invention and collecting the light fraction from the outlets therefor and the heavy fraction from the outlets therefore.

An embodiment of the present invention will now be described by way of example with reference to the accompanying drawing; in which:

DESCRIPTION OF THE PREFERRED EMBODIMENT

Figure 1:
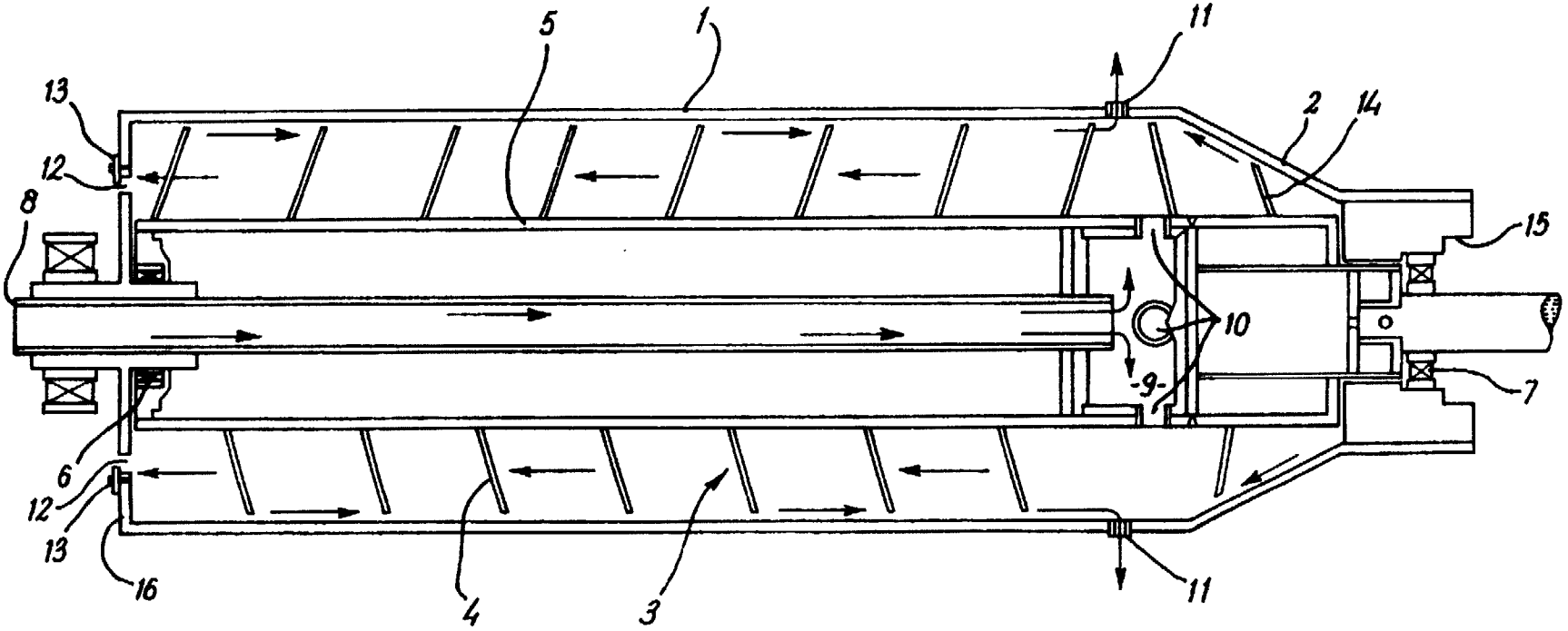
FIG. 1 is a cross-sectional side elevation of a general arrangement of a centrifuge embodying the present invention.

As shown in FIG. 1, a decanter centrifuge bowl has a relatively long cylindrical section 1 and a relatively short frusto-conical section 2 joined thereto and an end cover 16. The ratio of the length of the cylindrical section to the length of the frusto-conical section is about 7:1, and the ratio of the overall length of the bowl to the greatest bowl diameter is about 4:1. A scroll 3 comprises a helix 4 rigidly mounted on a axial tubular shaft 5, which is supported for rotation relative to the bowl in a first bearing G at the cylindrical end of the bowl and in a second bearing 7 at the fusto-conical end of the bowl. The helix 4 is shown for simplicity in cross-section in the shape of a parallel-sided strip which is angled so that its outer end is nearer than its inner end to the frusto-conical section 2. In practice, the helix 4 is of the same form as a spiral corkscrew. A pipe 8 for supply of feed suspension is mounted inside, and coaxially with, the tubular shaft 5. Feed suspension flows from the pipe 8 into a chamber 9 provided in the end of the tubular shaft 5 near to the frusto-conical section 2 of the bowl, and passes from there into the cavity of the bowl through openings 10 in the tubular shaft 5 (where it forms side walls of the chamber 9), four being provided but only three shown. The feed suspension thereby enters the space between the bowl and the tubular shaft 5 in four regions extending from and level with the openings 10 and collectively referred to hereinbefore as the 'delivery region'.

A heavy fraction of particles contained in the feed suspension sediments on the internal surface of the wall of the bowl and is discharged from the bowl through nozzles 11, which are disposed on a circumferential arc around the bowl near to the junction between the cylindrical section 1 and the frusto-conical section 2 of the bowl, but displaced by a short distance, eg. about 0.031 where 1 is the length of the internal cavity of the bowl, inside the cylindrical section 2. Four nozzles 11 are provided but only two are shown. A light fraction of particles contained in the feed suspension passes along the length of the bowl to the end cover 16 in which discharge ports 12 are provided. Each discharge port 12 is provided with an adjustable weir plate 13, by means of which the depth of the pond of liquid which forms around the wall of the bowl may be adjusted. Four discharge ports 12 are provided, but only two are shown. A scroll helix 14 which is situated between the nozzles 11 and the extreme end of the frusto-conical section 2 of the bowl is formed with a screw form which is reversed with respect to the helix 4 so that the helix 14 has in cross-section the same shape as the helix 4 but is angled with its outer end nearer than its inner end to the end cover 16. This arrangement enables the helix to convey towards the nozzles 11 any heavy fraction which is injected initially toward the extreme end of the frusto-conical section 2 (referred to hereinbefore as the 'second end' of the bowl) and is sedimented between the nozzles 11 and the extreme end of the frusto-conical section 2 of the bowl. The end of the frusto-conical section 2 of the bowl is provided on its outside with a socket 15 to receive a drive pulley (not shown), which is rigidly fixed to a socket provided on the outside of the end of the bowl by a suitable keying device. Rotary motion, eg. to provide a speed of about 2000 revolutions per minute about the axis of the bowl, is transmitted to the bowl through the drive pulley by means of an electric motor. Rotary motion about the axis of the scroll 3 at a speed which differs from the speed of the bowl by an appropriate amount in the same sense, eg. 20 revolutions per minute, is transmitted to the scroll 3 from the bowl through an hydraulic motor which is provided at the end of the cylindrical section 1 of the bowl. Use of an hydraulic motor, rather than a gearbox, to transmit motion from the bowl to the scroll 3 makes it possible to vary the speed differential between the bowl and the scroll 3 within a broad range to enable the centrifuge to be used efficiently for a wide variety of different applications.

EXAMPLE

An example of a use of the centrifuge shown in FIG. 1 is as follows. An aqueous slurry of kaolin particles is prepared in a well known manner. The slurry has the following properties:

Specific gravity 1.12;

Percentage of kaolin particles having a diameter less than 1 μm=less than 40%

Percentage of kaolin particles having a diameter less than 2 μm=less than 50%

Percentage of kaolin particles having a diameter greater than 10 μm=more than 10%.

The slurry is delivered as a feed suspension into the centrifuge shown in FIG. 1 via the inlet pipe 8. The bowl is rotated at a speed of about 2,000 rpm and the scroll is rotated in the same sense at a speed of about 2,020 rpm. A heavy fraction and a light fraction are separated by the centrifuge to give as the light fraction a finer product having the following properties:

Specific gravity 1.075

Percentage of kaolin particles having a diameter less than 1 μm=greater than 50%

Percentage of kaolin particles having a diameter less than 2 μm=greater than 70%

Percentage of kaolin particles having a diameter greater than 10 m=less than 1%

The coarse fraction separated and removed has a specific gravity of greater than 1.5.

Throughout the description and claims of the specification the word "comprise" and variations of the word, such as "comprising" and "comprises" is not intended to exclude other additives, components, integers or steps.

The invention claim is:

1. A decanter centrifuge for separating a feed suspension of particulate solid material in a liquid medium into a light fraction comprising a suspension of relatively light particles in the liquid medium or liquid medium containing a suspension of relatively heavy particles in the liquid medium, which centrifuge comprises an elongated bowl having a first closed end, a second closed end and a side wall between the ends, a helical scroll for rotation within, and coaxially with the bowl, driving means for rotating the bowl and the scroll about their common axis whereby the scroll and the bowl can be rotated with different rotational speeds, means for delivering the feed suspension into the bowl in a delivery region inside the bowl, a plurality of first outlets provided in the side wall of the bowl for discharging the heavy fraction from the bowl and one or more second outlets provided at or near the first end of the bowl for discharging the light fraction from the bowl and wherein the delivery region is nearer to the second end of the bowl than to the first end of the bowl and the first outlets are located close to the delivery region, the delivery region being nearer than the first outlets to the second end of the bowl.

2. A centrifuge as claimed in claim 1 and wherein the ratio of the overall length of the bowl to the greatest diameter of the bowl is in the range of from 2:1 to 5:1.

3. A centrifuge as claimed in claim 1 wherein said bowl has an internal cavity and wherein the distance measured longitudinally along the bowl, between the center of the delivery region and the first outlets is less than 0.31, where 1 is the length of the internal cavity of the bowl.

4. A centrifuge as claimed in claim 1 and wherein the scroll is provided on an axially extending tubular member having feed inlet openings through which the feed suspension can be delivered to the delivery region, the delivery region thereby comprising one or more regions extending into the bowl from the feed inlet opening or openings.

5. A centrifuge as claimed in claim 4 and wherein the means for delivering the feed suspension includes a feed pipe and an enclosure formed inside the tubular member, the feed pipe having an open end in the enclosure whereby feed suspension delivered along the feed pipe can debouch into the enclosure and can exit the enclosure via the feed inlet openings to enter the delivery region.

6. A centrifuge as claimed in claim 1 and wherein the side wall of the bowl comprises a section of narrowing diameter near to the second end of the bowl.

7. A centrifuge as claimed in claim 6 and wherein the side wall of the bowl comprises a frusto-conical section constituting the said section of narrowing diameter and also a cylindrical section joined thereto.

8. A centrifuge as claimed in claim 7 and wherein the delivery region and the first outlets are located inside the said cylindrical section near to the junction between the cylindrical section and the frusto-conical section.

9. A centrifuge as claimed in claim 7 and wherein the ratio of the length of the cylindrical section to the length of the frusto-conical section is in the range of from 6:1 to 8:1.

10. A centrifuge as claimed in claim 1 and wherein in operation the bowl and the scroll are independently rotated about their common axis and the heavy fraction of the feed suspension sedimented against the side wall of the bowl is conveyed toward the first outlets by the scroll and the light fraction of the feed suspension moves toward the second outlet or outlets.

11. A centrifuge as claimed in claim 1 wherein the helical scroll is a first scroll having a screw form and which includes a second scroll having a screw form and located between the first outlets and the second end of the bowl, the screw form of the second scroll being reversed with respect to the screw form of the first scroll to facilitate in operation conveyance of any feed suspension injected at the delivery region toward the second end of the bowl back toward the first and second outlets.

12. A method of operating a centrifuge as claimed in claim 1 so as to concentrate a feed suspension of a particulate solid material in a liquid medium or to separate such a suspension into a heavy fraction and a light fraction which method comprises applying the feed suspension to an inlet of the said centrifuge, whereby the feed suspension is delivered to the said delivery region and is thereby treated by the rotational action of the scroll and bowl of the centrifuge, and collecting heavy and light fractions separated by the centrifuge and discharged respectively at the first and second outlets.

13. A method as claimed in claim 12 and wherein the feed suspension comprises an aqueous suspension of an inorganic particulate material.

* * * * *